US008256857B2

(12) United States Patent
Folkins et al.

(10) Patent No.: US 8,256,857 B2
(45) Date of Patent: Sep. 4, 2012

(54) SYSTEM AND METHOD FOR COMPENSATING FOR SMALL INK DROP SIZE IN AN INDIRECT PRINTING SYSTEM

(75) Inventors: Jeffrey J. Folkins, Rochester, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 341 days.

(21) Appl. No.: 12/639,337

(22) Filed: Dec. 16, 2009

(65) Prior Publication Data

US 2011/0141171 A1 Jun. 16, 2011

(51) Int. Cl.
*B41J 29/38* (2006.01)

(52) U.S. Cl. ..... 347/10

(58) Field of Classification Search ..... 347/10–12, 347/14, 19

See application file for complete search history.

(56) References Cited

U.S. PATENT DOCUMENTS

| | | | |
|---|---|---|---|
| 5,583,550 | A | 12/1996 | Hickman et al. |
| 5,610,637 | A | 3/1997 | Sekiya et al. |
| 5,657,060 | A | 8/1997 | Sekiya et al. |
| 6,039,425 | A | 3/2000 | Sekiya et al. |
| 6,193,343 | B1 | 2/2001 | Norigoe et al. |
| 6,193,345 | B1 | 2/2001 | Feinn et al. |
| 6,193,347 | B1 | 2/2001 | Askeland et al. |
| 6,234,613 | B1 | 5/2001 | Feinn et al. |
| 6,259,463 | B1 | 7/2001 | Askeland et al. |
| 6,276,775 | B1 | 8/2001 | Schulte |
| 6,328,395 | B1 | 12/2001 | Kitahara et al. |
| 6,331,040 | B1 | 12/2001 | Yonekubo et al. |
| 6,575,545 | B2 | 6/2003 | Bruch et al. |
| 6,880,909 | B2 | 4/2005 | King et al. |
| 6,995,863 | B1 | 2/2006 | Miguel |
| 7,059,698 | B1 | 6/2006 | Mara, III et al. |
| 7,093,918 | B2 | 8/2006 | Askeland et al. |
| 7,281,778 | B2 | 10/2007 | Hasenbein et al. |
| 7,393,072 | B2 | 7/2008 | Lim et al. |
| 7,434,899 | B2 | 10/2008 | Nakajima |
| 7,452,042 | B2 | 11/2008 | Norigoe |
| 8,057,005 | B2 * | 11/2011 | Watt et al. ..... 347/14 |
| 2001/0012109 | A1 | 8/2001 | Magee |
| 2002/0167566 | A1 | 11/2002 | Schulte |
| 2008/0111844 | A1 | 5/2008 | Walmsley et al. |

* cited by examiner

*Primary Examiner* — An Do
(74) *Attorney, Agent, or Firm* — Maginot, Moore & Beck, LLP

(57) ABSTRACT

A method improves transfer efficiency of ink images on an image receiving member that were formed with small ink drops. The method includes identifying image data that correspond to ink drops that have a mass less than a predetermined threshold and that fail to comingle with another ink drop ejected with reference to the image data, modifying the identified image data to generate ink drops that comingle with at least one other ink drop ejected with reference to the image data, generating firing signals for inkjet ejectors in a print head with reference to the image data and modified image data, and ejecting in response to the firing signals a plurality of ink drops from the inkjet ejectors for each identified image data to enable a coalesced ink drop to form on an image receiving surface that has a mass that is greater than the predetermined threshold.

20 Claims, 3 Drawing Sheets

SYSTEM AND METHOD FOR COMPENSATING FOR SMALL INK DROP SIZE IN AN INDIRECT PRINTING SYSTEM

TECHNICAL FIELD

This disclosure relates generally to indirect printing systems, and more particularly, to indirect printing systems that transfer images to different types of media.

BACKGROUND

Droplet-on-demand ink jet printing systems eject ink droplets from print head nozzles in response to pressure pulses generated within the print head by either piezoelectric devices or thermal transducers, such as resistors. The ejected ink droplets are propelled towards an image receiving member where each ink droplet forms a spot or pixel on the image receiving member to produce an image. The print heads have droplet ejecting nozzles and a plurality of ink channels, usually one channel for each nozzle. The channels couple the nozzles to an ink reservoir in the print head to supply ink to the nozzles.

In a typical piezoelectric ink jet printing system, the pressure pulses that eject liquid ink droplets are produced by applying an electric pulse to the piezoelectric devices, one of which is typically located within each one of the ink channels. Each piezoelectric device is individually addressable to enable an electric pulse or firing signal to be generated and delivered to particular piezoelectric devices in a print head. The firing signal causes the piezoelectric device receiving the signal to bend or deform and pressurize a volume of liquid ink adjacent the piezoelectric device. As a voltage pulse is applied to a selected piezoelectric device, a quantity of ink is displaced from the ink channel and a droplet of ink is mechanically ejected from the nozzle associated with the selected piezoelectric device. The ejected droplets are propelled towards an image receiving member to form an image on the image receiving member. The respective channels from which the ink droplets were ejected are refilled by capillary action from an ink supply.

In some printers, commonly referred to as direct printers, the image receiving member is a sheet or web of receiving medium, such as paper. In other printers, commonly known as offset or indirect printers, the image receiving member is a rotating drum or belt coated with a release agent. The print head ejects droplets of melted ink onto a thin film of release agent coating the rotating image receiving member to form an image. This image is then transferred to a recording medium, such as a paper sheet. The release agent helps facilitate the transfer of the image because the image is really formed on the layer of release agent so the image does not affix to the image receiving member. The transfer is generally conducted in a transfixing nip formed by the rotating image receiving member and a rotating pressure roll, which is also called a transfix roll. The transfix roll may be heated or the recording medium may be pre-heated prior to entry in the transfixing nip. As a sheet of paper is transported through the nip, the fully formed image is transferred from the image receiving member to the sheet of paper and concurrently fixed thereon. This technique of using heat and pressure at a nip to transfer and fix an image to a recording medium passing through the nip is typically known as "transfixing," a well known term in the art.

In some print head systems known to the art, each ink droplet has a mass of approximately 20 nanograms (ng). Some newer print head systems eject droplets with a smaller mass, typically of about 10 ng or less. These small droplets form smaller pixels on the image receiving member, which has the advantage of generating finer resolution images where more pixels may be placed in a given surface area. Another advantage is that a printing system that uses smaller droplets may position each droplet deposited on the image receiving member with greater precision.

The use of small droplets in indirect printing systems does have the drawback that these small droplets may result in "image dropout" during the transfixing process. Image dropout occurs when an ink drop remains on the image receiving member rather than being transferred to the recording medium. Image dropout may produce an image in which partial or missing drops are noticeable in the image on the recording medium after transfixing is completed. In indirect printing systems these small droplets do not transfer from the image receiving member as well as larger drops do, resulting in image dropout. The image dropout is exacerbated when a rougher-surfaced medium like recycled paper passes through the nip.

In an effort to reduce dropout, present indirect printers with pixels formed from small droplets may pass print media through the nip at a slower rate of speed, but this negatively affects a printer's throughput efficiency. A printing system that utilizes print heads that produce small droplets, while also avoiding image dropout or the need to reduce the throughput of print media, benefits the field.

SUMMARY

A method enables print heads that eject small ink drops to be used in indirect printing systems without significant adverse impact on the efficiency of image transfer to media in a transfix nip. The method includes identifying image data that correspond to ink drops that have a mass less than a predetermined threshold and that fail to comingle with another ink drop ejected with reference to the image data, modifying the identified image data to generate ink drops that comingle with at least one other ink drop ejected with reference to the image data, generating firing signals for inkjet ejectors in a print head with reference to the image data and modified image data, and ejecting in response to the firing signals a plurality of ink drops from the inkjet ejectors for each identified image data to enable a coalesced ink drop to form on an image receiving surface that has a mass that is greater than the predetermined threshold.

A system for implementing the printing method for small ink drops has been developed. The system includes a print head having a plurality of inkjet ejectors that are configured to eject ink drops having a mass that are less than a predetermined threshold, an image receiving member positioned to rotate opposite the print head and receive the ink drops ejected by the print head, a transfix roll configured to move towards and away from the image receiving member to form selectively a transfer nip for transferring an ink image formed on the image receiving member with ink drops ejected from the print head to a media sheet passing through the transfer nip, and a controller configured to generate firing signals that cause the inkjet ejectors to eject each drop for an image with at least one other ink drop ejected from the print head to enable a coalesced ink drop that has a mass that is greater than the predetermined threshold to form on the image receiving surface.

The method described below improves ink transfer efficiency for an ink image formed on image receiving member with small ink drops. The method includes identifying ink drops corresponding to image data that having a mass less than a predetermined threshold, halftoning the image data to enable each ink drop corresponding to the identified ink drops to be comingled with at least one other ink drop ejected with reference to the halftoned image data, generating firing signals for inkjet ejectors in a print head with reference to the halftoned image data, and ejecting ink drops in response to the firing signals to enable a coalesced ink drop having a mass that is greater than the predetermined threshold to form on an image receiving member.

BRIEF DESCRIPTION OF THE DRAWINGS

The foregoing aspects and other features of a system and method that enables isolated single ink drops to be ejected in proximity to other ink drops in the process direction in an indirect printing system are explained in the following description, taken in connection with the accompanying drawings.

DETAILED DESCRIPTION

Figure 1:
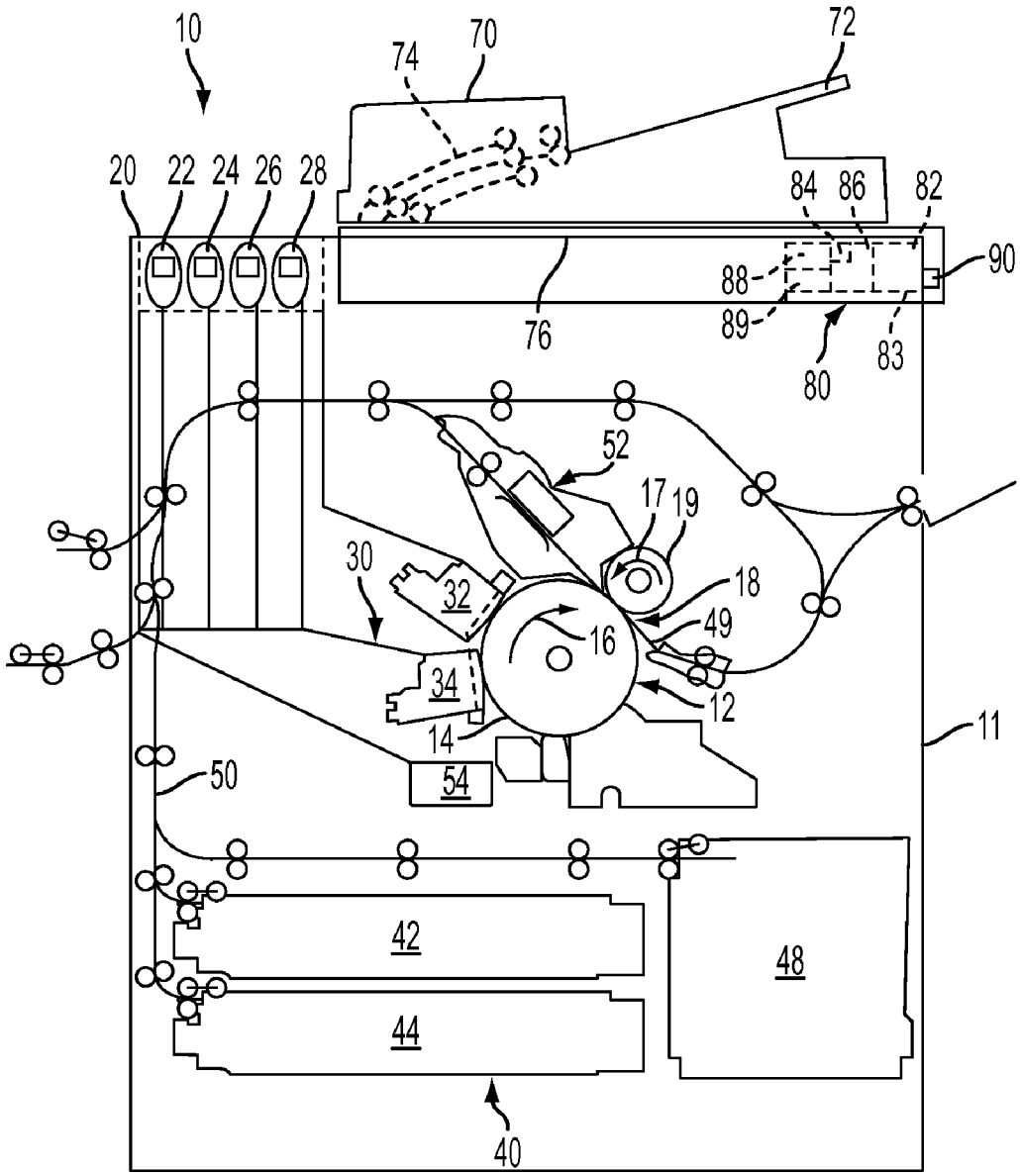
FIG. 1 is a schematic, side elevation view of an ink jet printer that is configured to implement the process disclosed below.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like. The description presented below is directed to an indirect printing system that ejects multiple ink drops for one or more image pixels to enhance the efficiency of the transfer of images generated with small ink drops. A "media sheet" as used in this description may refer to any type and size of medium that printers in the art create images on, with one common example being letter sized printer paper. Additionally, the printing system described below may have embodiments that can monitor image content of images that will be placed onto media sheets, and determine whether the operation of the print heads may be adjusted to enhance image transfer. Also, as used herein, small ink drops are ink drops ejected by inkjet ejectors in print heads that have a mass that is less than 15 ng.

Referring now to FIG. 1, an embodiment of an image producing machine, such as a high-speed phase change ink image producing machine or printer 10, is depicted. As illustrated, the machine 10 includes a frame 11 to which are mounted directly or indirectly all its operating subsystems and components, as described below. To start, the high-speed phase change ink image producing machine or printer 10 includes an image receiving member 12 that is shown in the form of a drum, but can equally be in the form of a supported endless belt. The image receiving member 12 has an imaging surface 14 that is movable in the direction 16, and on which phase change ink images are formed. A transfix roll 19 rotatable in the direction 17 is loaded against the surface 14 of drum 12 to form a transfix nip 18, within which ink images formed on the surface 14 are transfixed onto a heated media sheet 49.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CMYK (cyan, magenta, yellow, black) of phase change inks. The phase change ink delivery system also includes a melting and control apparatus (not shown) for melting or phase changing the solid form of the phase change ink into a liquid form. The phase change ink delivery system is suitable for supplying the liquid form to a print head system 30 including at least one print head assembly 32. Since the phase change ink image producing machine or printer 10 is a high-speed, or high throughput, multicolor image producing machine, the print head system 30 includes multicolor ink print head assemblies and a plural number (e.g., two (2)) of separate print head assemblies 32 and 34 as shown, although the number of separate print head assemblies may be one or any number greater than two.

As further shown, the phase change ink image producing machine or printer 10 includes a substrate supply and handling system 40. The substrate supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate handling and treatment system 50 that has a substrate heater or pre-heater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated mini-computer having a central processor unit (CPU) 82 with electronic storage 83, and a display or user interface (UI) 86. The ESS or controller 80, for example, includes a sensor input and control circuit 88 as well as a pixel placement and control circuit 89. In addition, the CPU 82 reads, captures, prepares, and manages the image data flow between image input sources, such as the scanning system 76, or an online or a work station connection 90, and the print head assemblies 32 and 34. As such, the ESS or controller 80 is the main multi-tasking processor for operating and controlling all of the other machine subsystems and functions, including the printing process discussed below.

The controller 80 may be implemented with general or specialized programmable processors that execute programmed instructions. The instructions and data required to perform the programmed functions may be stored in memory associated with the processors or controllers. The processors, their memories, and interface circuitry configure the controllers to perform the processes, described more fully below, that enable the print heads to be fired in a manner that modifies image data to prevent single ink drops having a mass less than a predetermined threshold that are also not adjacent to at least one other ink drop in the process direction from being ejected onto the image receiving member. The value of this threshold mass is stored in the processor's memory, and in one known embodiment the threshold may be set to 12 ng. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

In operation, image data for an image to be produced are sent to the controller 80 from either the scanning system 76 or via the online or work station connection 90 for processing and output to the print head assemblies 32 and 34. Additionally, the controller determines and/or accepts related subsystem and component controls, for example, from operator inputs via the user interface 86, and accordingly executes such controls. As a result, appropriate solid forms of differently colored phase change ink are melted and delivered to the print head assemblies. Additionally, inkjet control is exercised with the generation and delivery of firing signals to the print head assemblies to form images on the imaging surface 14 that correspond with the image data. The print head assemblies are configured so that they may deposit at least 400 small ink droplets into a line 1 inch long, which corresponds to a 400 dpi resolution. Media substrates are supplied by any one of the sources 42, 44, 48 and handled by substrate system 50 in timed registration with image formation on the surface 14. The timing of the transporting of the media sheets to the nip, the regulation of the rotation speed for the image receiving member, and the positioning of the transfix roll are performed by the processes described above for appropriate printing operations. After an image is fixedly fused to an image substrate, it is delivered to an output area.

The controller may be configured with multiple print modes. In a print mode in which small ink drops are ejected to form ink images, the controller is configured to identify image data that correspond to ink drops that are less than a predetermined threshold and that fail to comingle with another ink drop ejected with reference to the image data. In one embodiment, the image data are halftone image data generated from image data input to the printing system. Each position in the array for the halftone image stores a binary value that indicates whether an ink drop should be ejected for the position. The process direction is the direction in which the image receiving member turns. Thus, a line is generated in the process direction by sequentially ejecting ink drops from an inkjet ejector as the image receiving member moves past the ejector. Image data at positions in the array that are not adjacent to positions in the process direction that have a binary value indicative of an ink drop being ejected are identified for image data modification. In some embodiments, the small ink drops for the image data isolated in the process direction may efficiently transfer from the image receiving member to a media sheet having a relatively smooth surface. Media having a rough surface, however, may present transfer issues. In these embodiments, the controller may automatically enter the isolated single drop evaluation mode when a media selector 84, which signals the controller with information about media stored in the various media sources, indicates that rough-surface media are to be used in a print process. Additionally, the user may alter the print mode to perform such a printing mode by activating the print mode manually via the user interface.

Figure 2:
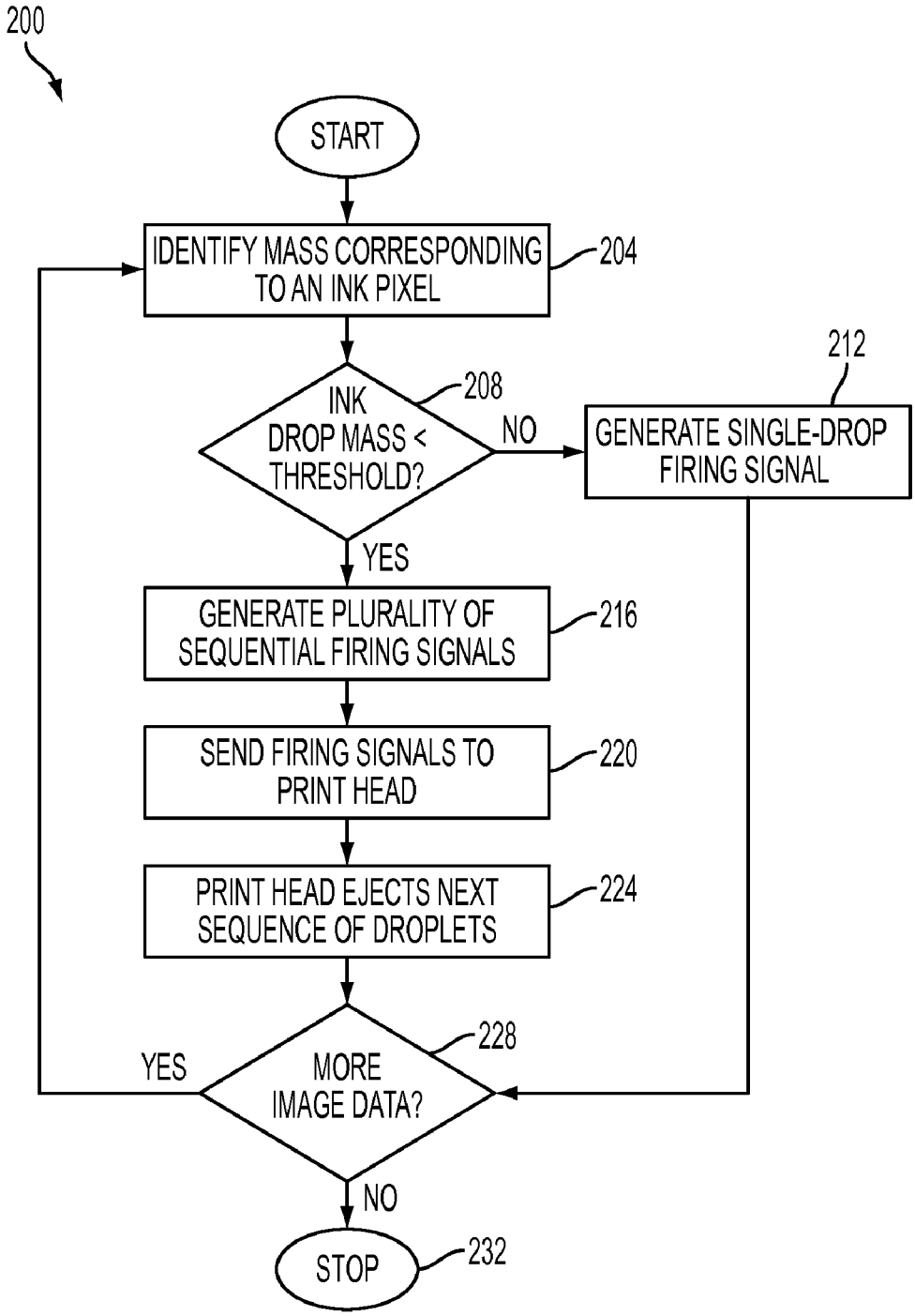
FIG. 2 is a flow diagram of a process that controls a print head that ejects small ink drops to be used in indirect printing systems without significant adverse impact on the efficiency of image transfer to media.

A printing process that increases throughput while avoiding a loss of image quality due to dropout is show in FIG. 2. The process 200 is performed by a controller executing stored instructions to operate on image data that are used to generate firing signals for the print heads. The process begins with the controller identifying image data stored in the memory of the printing system that correspond to ink drops that are less than a predetermined threshold and that fail to comingle with another ink drop ejected with reference to the image data (block 204). As noted above, this identification may be performed by analyzing binary values in a halftone image.

In other embodiments, the halftone image may use at least three data values that correspond to no drop being ejected, a small drop being ejected, and a first and a second small drop being ejected. Alternately a fourth value could be added for printing only the second small drop. For these halftone images (block 206), the process of FIG. 2 compares the image data for the single drop image data in the process direction to a predetermined threshold for the small drop (block 208). If the single drop image data corresponds to one of the small drops, image data modification is performed (block 212). Firing signals are then generated in accordance with the modified image data (block 216) and the modified data results in the sequential ejections of ink drops in the process direction (block 220), rather than single isolated ink drop ejections. These multiple ink drops enable a coalesced ink drop to form on an image receiving surface that has a mass that is greater than the predetermined threshold. These sequential ejections could be both small drops for a pixel, the first small drop of a pixel and the second small drop of a previous pixel, or the second small drop of a pixel and the first small drop of the next pixel. The sequential ink drop ejections of the small mass ink drops in the process direction enable the ejected ink drops to coalesce on the image receiving member with a mass that enables the coalesced drop to transfer to media more easily than a single small ink drop. The firing signals may cause an ink ejector to eject the ink drops corresponding to the modified data on a single pass of the image receiving member as it moves past the print head or the signals may cause an ink ejector to eject the ink drops on different passes of the image receiving member as it moves past the print head.

In other embodiments a mode is provided in which small drops are printed so more than one is always combined with other drops to produce an agglomerated drop on the transfer surface that is larger than the threshold drop size. To accomplish this, the combining drops must be printed close enough to each other both spatially and temporally that the drops overlap and flow at their interfaces. This action forms a larger drop on the transfer surface. In many cases these requirements mean the drops are printed within the same pass of the print engine and aligned in the process direction on adjacent drop firing cycles. In some cases, however, the resolution is high enough in the process direction that drops that are printed on firing cycles that are not adjacent to one another but are sufficiently near to one another that they flow together to form a single drop. In other cases, such as in single pass printing, adjacent drops in the cross process direction are possibly within the distance required to enable the drops to combine and form a single drop. In this later case the required drop threshold can be achieved by multiple drop ejections in either the process or cross-process direction or both.

The modification of image data may be performed in a variety of ways. In one approach, the modification may be performed as a second process after a halftone image is determined. Alternatively, the modification may be done as part of the halftoning process. Halftoning as used herein refers to the process of converting input image data to binary or multilevel image data representing the drops to be printed. Halftoning may be accomplished with a halftone screen or with a stochastic process such as error diffusion. Additionally, the resolution of the image data in the process direction may be increased, for example, doubled, and the single small drop data repeated in the process direction. The additional small drop data may be positioned before or after the single small drop data in the process direction. The resolution increase may be tripled or increased by an even larger factor to enable multiple additional small drops to be ejected sequentially from an inkjet ejector to form a coalesced ink drop on the image receiving member. The modification helps ensure that no single ink drops are generated that are not adjacent another ejected ink drop in the process direction. Thus, single ink isolated ink drops on the image receiving member are avoided and transfer of the ejected ink from the image receiving member to a media sheet is improved.

In another embodiment, the controller is configured to generate the firing signals by generating two (2) firing signals to produce two small droplets for each single isolated small mass ink droplet, but other embodiments may generate data that produce firing signals by generating firing signals for ejecting three or more droplets. In the system of FIG. 2, the firing signals to the print heads allow the printing system to deposit at least 400 of the small droplets into a line one inch long, which corresponds to a 400 dpi minimum resolution.

Figure 3:
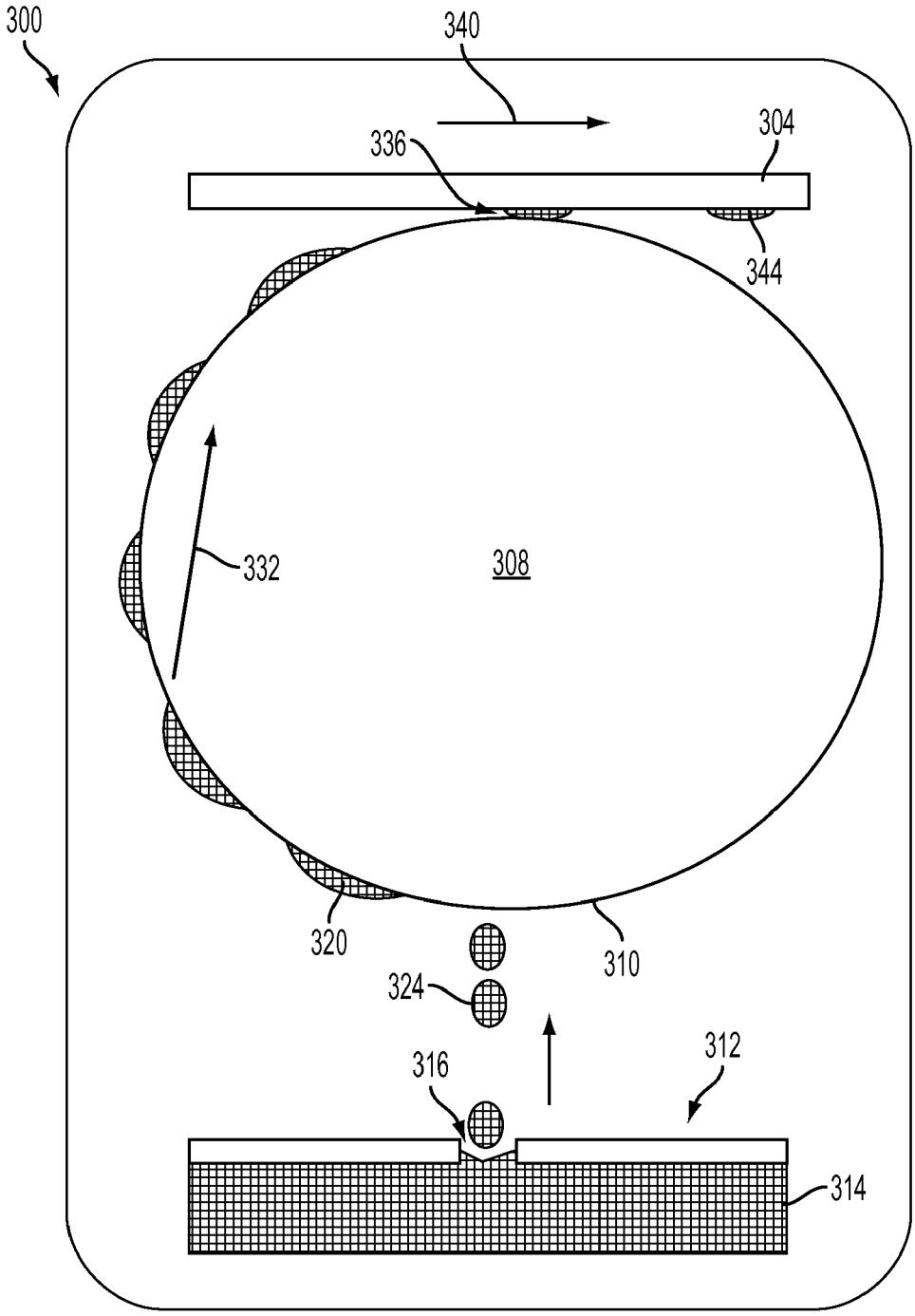
FIG. 3 depicts the ejection of ink droplets from a print head onto the image receiving member of the printing system described in FIG. 1 and FIG. 2.

FIG. 3 depicts components of a printing system 300 that deposits a sequence of small ink droplets 324 onto the image receiving member 308 to form an image. The image is then transferred to a recording medium 304. The process begins when ink held in the ink reservoir 314 is ejected from the nozzle 316 of the print head 312. As discussed above, the print head ejects a sequence of adjacent small droplets in response to firing signals from the controller (not pictured). In the present embodiment, each droplet is deposited onto a thin layer of release agent coating the surface of the image receiving member in an area 310. The timing of the firing signals causes the print head to eject the sequence of small droplets so that they coalesce together to form a pixel 320 on the image receiving member that is larger than a pixel produced by a single small mass ink droplet.

Continuing to refer to FIG. 3, the image receiving member rotates in a process direction 332 to carry the pixels deposited on the member to the nip 336 for transfixing. After transfixing, each pixel has been transferred to the media sheet 304 as a transfixed dot 344. The reader should appreciate that FIG. 3 is a simplified view of the printing and transfixing process as a full image is typically formed in a document area on a the member and the entire image is transferred to the medium passing through the nip. Additionally, while only one print head is depicted in FIG. 3, the process described above may be used in printing systems having multiple print heads that eject ink droplets of different colors onto the image receiving member.

The method and system described above improve transfer efficiency for an ink image formed on image receiving member with small ink drops. Image data used to generate ink drops to form an ink image on an image receiving member are analyzed to identify ink drops corresponding to image data that having a mass less than a predetermined threshold. The image data are halftoned to enable each ink drop corresponding to the identified ink drops to be comingled with at least one other ink drop ejected with reference to the halftoned image data. Firing signals are generated for the inkjet ejectors in a print head with reference to the halftoned image data and the ink drops are ejected in response to the firing signals to enable a coalesced ink drop having a mass that is greater than the predetermined threshold to form on an image receiving member. The generation of the firing signals may include the generation of a plurality of firing signals and the plurality of firing signals may cause an inkjet ejector to eject ink drops in a single pass of the image receiving member past the print head to form the coalesced ink drop.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for improving transfer efficiency of ink images on an image receiving member that were formed with small ink drops comprising:

identifying image data that correspond to ink drops that have a mass less than a predetermined threshold and that fail to comingle with another ink drop ejected with reference to the image data;

modifying the identified image data to generate ink drops that comingle with at least one other ink drop ejected with reference to the image data;

generating firing signals for inkjet ejectors in a print head with reference to the image data and modified image data; and ejecting in response to the firing signals a plurality of ink drops from the inkjet ejectors for each identified image data to enable a coalesced ink drop to form on an image receiving surface that has a mass that is greater than the predetermined threshold.

2. The method of claim 1, the image data identification further comprising:

generating halftone image data from the image data; and identifying with reference to the halftone image data the image data that correspond to ink drops that have a mass less than a predetermined threshold and that fail to comingle with another ink drop ejected with reference to the image data.

3. The process of claim 2 wherein the modification of the image data is performed during the generation of the halftone image data.

4. The method of claim 1, the identification of the image data being made in response to media being selected for image transfer that have a predetermined roughness.

5. The method of claim 1, wherein the predetermined threshold is 15 ng.

6. The method of claim 1, wherein the firing signals enable the inkjet ejectors to eject the ink drops having a mass less than the predetermined threshold at a rate of at least 400 ink drops per inch.

7. The method of claim 1, the modification of the image data further including:

increasing a resolution of the image data in the process direction; and generating at least one image data value in the process direction that results in an ink drop being ejected that comingles with another ink drop to form an ink drop on the image receiving surface that has a mass that is greater than the predetermined threshold.

8. The process of claim 1 wherein the ink drops in the plurality of ink drops are ejected by a single inkjet ejector in response to the firing signals.

9. The process of claim 8 wherein the single inkjet ejector ejects the plurality of ink drops during a single pass of the image receiving member as the image receiving member moves past the print head.

10. The process of claim 1 wherein the firing signals cause multiple inkjet ejectors to form at least one coalesced ink drop on the image receiving member.

11. A system for improving transfer efficiency of ink images on an image receiving member that were formed with small ink drops comprising:

a print head having a plurality of inkjet ejectors that are configured to eject ink drops having a mass that are less than a predetermined threshold;

an image receiving member positioned to rotate opposite the print head and receive the ink drops ejected by the print head;

a transfix roll configured to move towards and away from the image receiving member to form selectively a transfer nip for transferring an ink image formed on the image receiving member with ink drops ejected from the print head to a media sheet passing through the transfer nip; and a controller configured to generate firing signals that cause the inkjet ejectors to eject each drop for an image with at least one other ink drop ejected from the print head to enable at least one coalesced ink drop that has a mass that is greater than the predetermined threshold to form on the image receiving surface.

12. The system of claim 11, the controller being further configured to generate the firing signals by identifying image data that correspond to ink drops that have a mass less than a predetermined threshold and that fail to comingle with another ink drop ejected with reference to the image data, modifying the identified image data to generate ink drops that comingle with at least one other ink drop ejected with reference to the image data, and generating the firing signals for inkjet ejectors in a print head with reference to the image data and modified image data.

13. The system of claim 11, the controller being further configured to generate halftone image data from the image data, and to identify with reference to the halftone image data the image data that correspond to ink drops that have a mass less than a predetermined threshold and that fail to comingle with another ink drop ejected with reference to the image data.

14. The system of claim 11 further comprising:

a selector that is configured to enable selection of a media supply that delivers media sheets to the system for transferring images from the image receiving member to the media sheets; and the controller being further configured to receive a signal from the selector that identifies the selected media supply, the controller identifying a roughness parameter associated with the media sheets in the selected media supply and the identification of the image data being made in response to a media having a predetermined roughness being selected for image transfer.

15. The system of claim 11 further comprising:

a selector that is configured to enable selection of a printing mode for the print head from a plurality of printing modes, at least one of the printing modes enabling the print head to eject ink drops that have a mass that are smaller than the predetermined threshold; and the controller being further configured to receive a signal from the selector that identifies the selected printing mode and the identification of image data being made in response to a print mode being selected that operates the print head to eject ink drops having a mass less than the predetermined threshold.

16. The system of claim 11 wherein the predetermined threshold is 15 ng.

17. The system of claim 11 wherein the firing signals enable the nozzle to eject the ink drops having a mass less than the predetermined threshold at a rate of at least 400 drops per inch.

18. A method for improving transfer efficiency of an ink image formed on image receiving member with small ink drops, the method comprising:

identifying ink drops corresponding to image data that having a mass less than a predetermined threshold;

halftoning the image data to enable each ink drop corresponding to the identified ink drops to be comingled with at least one other ink drop ejected with reference to the halftoned image data;

generating firing signals for inkjet ejectors in a print head with reference to the halftoned image data; and ejecting ink drops in response to the firing signals to enable a coalesced ink drop having a mass that is greater than the predetermined threshold to form on an image receiving member.

19. The method of claim 18 further comprising:

firing multiple inkjet ejectors in response to the firing signals to form at least one coalesced ink drop on the image receiving member generating a plurality of firing signals.

20. The method of claim 19 wherein the plurality of firing signals cause an inkjet ejector to eject ink drops in a single pass of the image receiving member past the print head to form the coalesced ink drop.

* * * * *